US010092102B2

(12) United States Patent
Cattaneo

(10) Patent No.: US 10,092,102 B2
(45) Date of Patent: Oct. 9, 2018

(54) VISIBLE HANGING BRACKET WITH AN IMPROVED ANTI-DISENGAGEMENT SYSTEM FOR WALL CUPBOARDS

(71) Applicant: LEONARDO S.R.L., Figino Serenza, Coma (IT)

(72) Inventor: Carlo Cattaneo, Como (IT)

( * ) Notice: Subject to any disclaimer, the term of this patent is extended or adjusted under 35 U.S.C. 154(b) by 0 days.

(21) Appl. No.: 15/316,174

(22) PCT Filed: Jun. 17, 2015

(86) PCT No.: PCT/EP2015/001227
§ 371 (c)(1),
(2) Date: Dec. 4, 2016

(87) PCT Pub. No.: WO2015/197175
PCT Pub. Date: Dec. 30, 2015

(65) Prior Publication Data

US 2017/0143119 A1 May 25, 2017

(30) Foreign Application Priority Data

Jun. 23, 2014 (IT) ..... MI2014A1134

(51) Int. Cl.
*A47B 95/00* (2006.01)

(52) U.S. Cl.
CPC ..... *A47B 95/008* (2013.01)

(58) Field of Classification Search
CPC ..... A47B 95/08
See application file for complete search history.

(56) References Cited

U.S. PATENT DOCUMENTS

| | | | | | |
|---|---|---|---|---|---|
| 3,337,172 | A * | 8/1967 | Jackson | A47B 96/068 | 248/222.51 |
| 4,662,761 | A * | 5/1987 | Hoffman | A47B 88/493 | 384/18 |
| 5,351,929 | A * | 10/1994 | Vallance | A47B 95/008 | 248/222.51 |
| 2006/0091271 | A1* | 5/2006 | Nowak | A47B 95/008 | 248/225.21 |
| 2012/0018602 | A1* | 1/2012 | Cattaneo | A47B 95/008 | 248/222.11 |

FOREIGN PATENT DOCUMENTS

| | | |
|---|---|---|
| DE | 202009000514 | 5/2010 |
| EP | 0033179 | 8/1981 |
| EP | 0632979 | 1/1995 |

(Continued)

*Primary Examiner* — Anita M King
(74) *Attorney, Agent, or Firm* — Themis Law

(57) ABSTRACT

A visible hanging bracket with an anti-disengagement system for wall cupboards, wherein a cupboard is hooked to a support fixed to a wall with a hook with a tooth of a hanging bracket device of the type, in which a releasable reciprocal constraint member is disposed between the hook and the support and includes a screw screwed onto the hook and suitable for interfering with the support. The screw is screwed into a threaded seat positioned on a section forming part of and incorporated in the hook, the section being opposed to the tooth at a height substantially identical, and the tip or end part of the screw engages a horizontal flap (edge) folded directly from the section of the bar.

9 Claims, 8 Drawing Sheets

(56) References Cited

FOREIGN PATENT DOCUMENTS

| | | |
|---|---|---|
| EP | 2807954 | 12/2014 |
| FR | 2404411 | 4/1979 |
| JP | S57129446 | 8/1982 |
| WO | 2010121687 | 10/2010 |
| WO | 2012084067 | 6/2012 |

* cited by examiner

VISIBLE HANGING BRACKET WITH AN IMPROVED ANTI-DISENGAGEMENT SYSTEM FOR WALL CUPBOARDS

FIELD OF THE INVENTION

The present invention relates to a visible hanging bracket with a perfected anti-disengagement system for wall cupboards, hooked to a support fixed to a wall, generally a metal bar or sheet, suitably shaped.

BACKGROUND OF THE INVENTION

As is well-known to skilled persons in the field, a system for constraining a cupboard to the wall envisages the use of a visible hanging bracket device comprising a hook which extends at the rear through the lining (if present) of the cupboard, to be freely hooked to the above-mentioned bar or plate fixed to the wall.

Two regulation mechanisms generally cooperate with said hook, for the regulation of the depth (horizontal) and height (vertical) of the hanging bracket, equipped with respective lead screws.

Visible hanging brackets of this type are known, for example, from patents EP 0033179 B1 and EP 0632979 A1, to which reference should be made for further clarifications and which should be considered as being an integral part of the present description.

When forces directed upwards are applied to the hooked cupboard, this can become unhooked from the support and fall, causing damage, also severe, not only to objects, but above all to people.

This possibility is currently even more probable, as the custom of assembling wall cupboards also at relatively low heights from the floor, is becoming more and more frequent, and, as mentioned above, this increases the risk of accidental disengagement, especially due to children.

In addition, safety regulations have entered, and will enter, into force in many countries, which require the provision of accidental anti-disengagement systems in wall cupboards.

European patent application EPA 10708147.3, filed on 5 Mar. 2010 in the name of the same Applicant, proposes a very satisfactory solution to the problem indicated above, for avoiding the accidental disengagement of a wall cupboard from its support, caused by forces directed upwards applied to the same cupboard.

According to European patent application EPA 10708147.3, to which reference should be made for clarifications and which should be considered as being an integral part of the present description, an anti-disengagement system is proposed for wall cupboards wherein a cupboard is fixed to the wall by means of a hook of a hanging bracket device, characterized in that releasable reciprocal constraint means are envisaged between said hook and said support.

It is also highly desirable and required to prevent the accidental disengagement of a wall cupboard from its support also due to horizontal forces, directed laterally with respect to the shoulders of the same cupboard, which can also be combined with vertical forces directed upwards.

European patent application EPA 14164730.5, filed on 15 Apr. 2014 in the name of the same Applicant, proposes an extremely satisfactory solution to the above problem for avoiding the accidental disengagement of the cupboard from its support, caused by horizontal forces, directed laterally with respect to the shoulders of the same cupboard, which can also be combined with vertical forces directed upwards.

According to European patent application EPA 14164730.5, to which reference should be made for clarifications and which should be considered as being an integral part of the present description, an anti-disengagement system for wall cupboards is proposed, wherein a cupboard is hooked to a support fixed to a wall by means of a hook of a hanging bracket device. Said anti-disengagement system is of the type wherein releasable reciprocal constraint means are envisaged between said hook and said support. Said releasable reciprocal constraint means consist of a bead screwed onto said hook and suitable for interfering with said support; the system is characterized in that side blocking or stop elements cooperate with said bead, against side movements of the same bead caused by horizontal forces acting on said cupboard.

SUMMARY OF THE INVENTION

Visible hanging brackets produced according to the teachings of European patent applications EPA 10708147.3 and EPA 14164730.5 have given completely satisfactory results and an objective of the invention is to provide a visible hanging bracket equipped with an anti-disengagement system which is even more simple to construct and which does not complicate the assembly of the cupboard to the wall.

The assembly of the cupboard to the wall could be complicated by the fact that the bead of the anti-disengagement system could encounter, during its screwing passage, the head of the fixing dowel or screw of the support fixed to the wall (bar or plate). In this case, the anti-disengagement system would not be activated, as the bead would not be able to interact correctly with the bar or plate fixed to the wall.

A further objective of the invention is therefore to exclude the possibility of such an occurrence.

Another objective of the invention is to provide a visible hanging bracket with an anti-disengagement system which can be easily released, i.e. which, in the case of necessity, allows the easy and rapid disassembly of the cupboard from the wall.

The objectives indicated above are achieved, according to the invention, by a visible hanging bracket with a perfected anti-disengagement system as defined in the enclosed claims, the main claim and the dependent claims.

The structural and functional characteristics of the invention and its advantages with respect to the known art can be easily understood from the enclosed description, referring to the enclosed drawings, which show a possible exemplifying embodiment of a visible hanging bracket with an anti-disengagement system for wall cupboards produced according the innovative principle of the invention.

DETAILED DESCRIPTION OF EMBODIMENTS OF THE INVENTION

Figure 1:
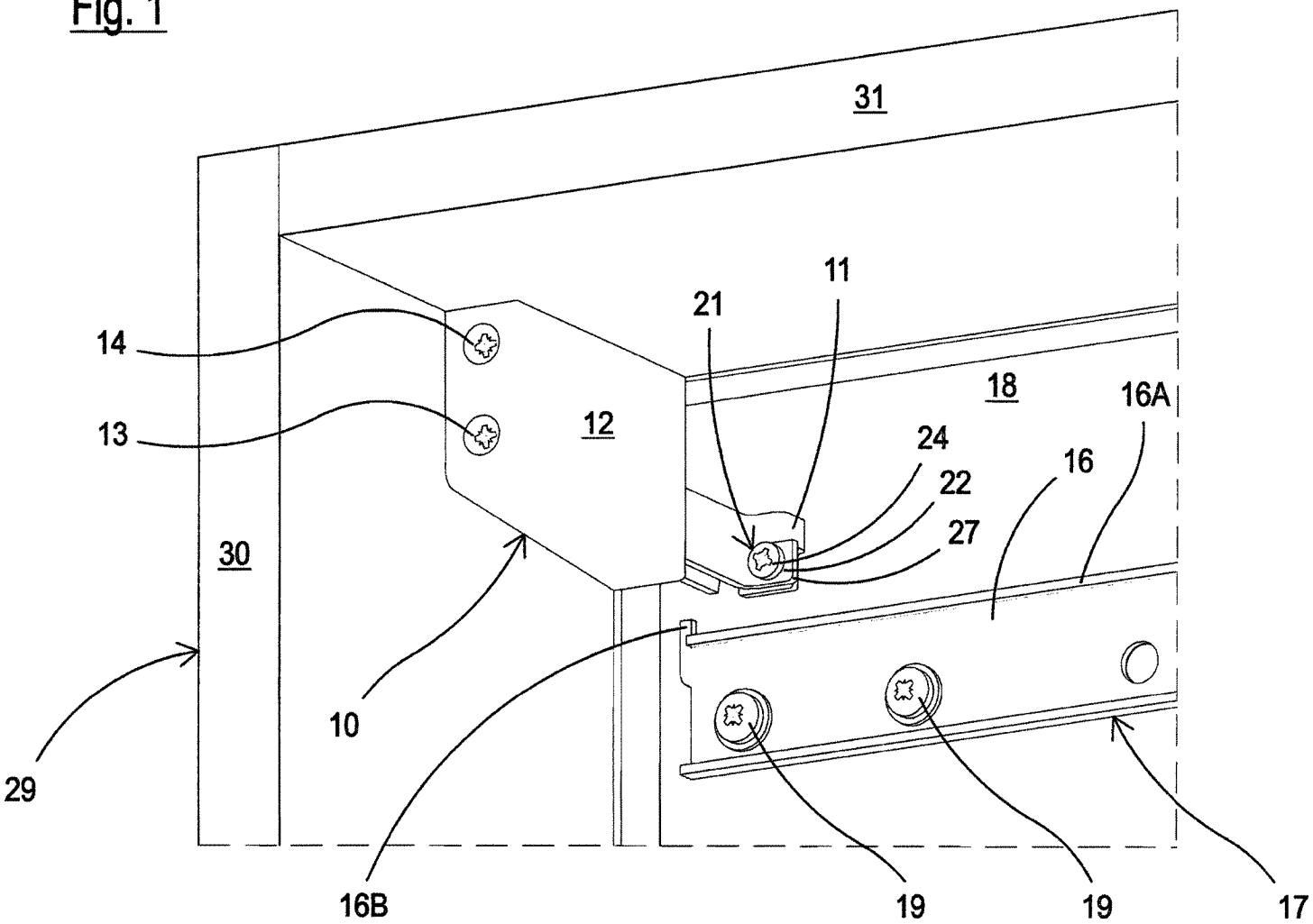
FIG. 1 is a perspective view illustrating a visible hanging bracket with an anti-disengagement system according to the invention with the cupboard in the hooking phase to a supporting bar fixed to the wall.
Figure 3:
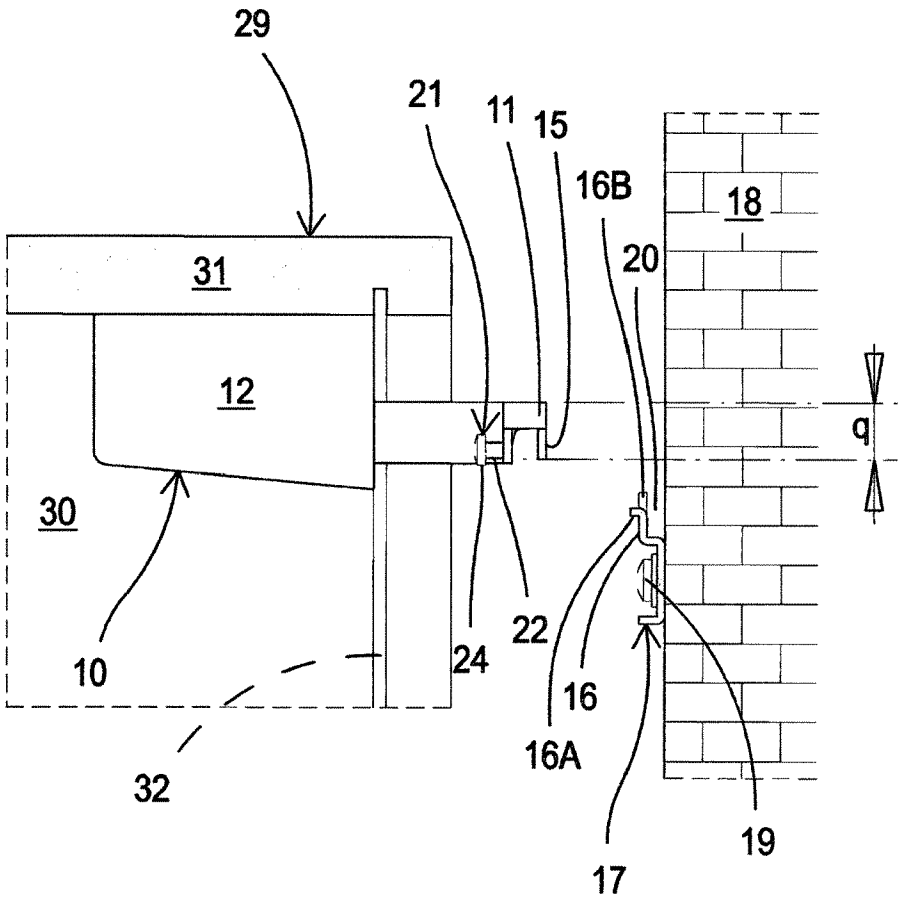
FIG. 3 is a detail in a vertical section of the cupboard of FIG. 1.
Figure 2:
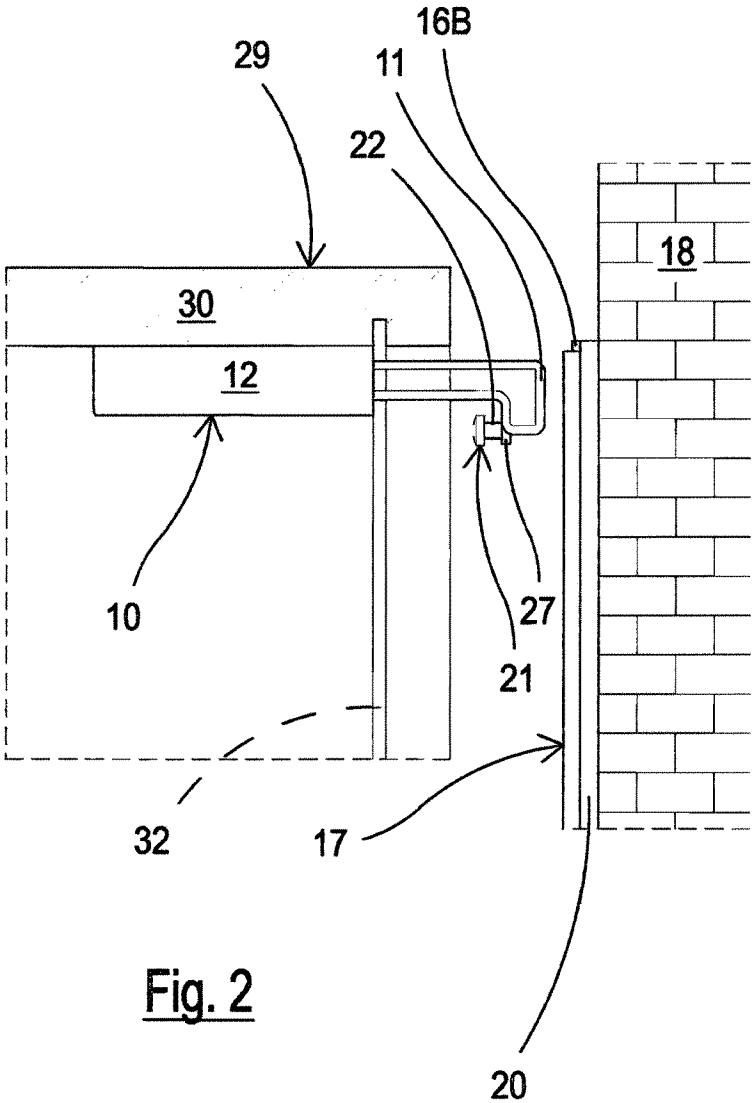
FIG. 2 is a detail in a plan section of the cupboard of FIG. 1.

With reference first of all to FIGS. 1-3 of the drawings, 10 indicates as a whole, a visible hanging-bracket device of the type generally known, for example described in patents EP 0033179 B1 and EP 0632979 A1, to which reference should be made for any necessary clarifications, and which should be considered as being an integral part of the present description, as non-limiting examples of hanging brackets of the known type.

The hanging bracket 10 comprises a movable hook 11 which extends from a box-like body 12.

A regulation mechanism (known) of the position in depth (horizontal) and height (vertical) of the hook 11, is contained inside the box-like body 12, by means of respective screws 13, 14.

The hook 11 terminates, in the front, with a tooth 15 destined for being hooked to a corresponding section 16 of a metal bar 17 fixed to the wall 18 by means of dowels 19.

As can be clearly seen from the drawings, the section 16 of the bar 17, defines with the wall 18, a channel 20 in which the tooth 15 is housed. The bar 17, preferably and as an example, has a "C"-shaped section from whose upper wing AS the above-mentioned section 16 extends vertically. The bar 17, however, can have sections different from the "C"-shaped section illustrated, for example a section in which the lower wing AI of the "C" is missing, or also other sections.

An anti-disengagement system according to the invention, cooperates with the tooth 15 of the hook 11, and with the bar 17, which, in the embodiment shown in the drawings, consists of a screw 21 having a threaded section 22, a tip 23, and a shaped head 24 for a manoeuvring tool, for example a screwdriver 25.

Said screw 21 is screwed into a threaded seat 26, formed on a section 27 which is part of and incorporated in the hook 11. The section 27 is substantially opposed (not completely offset) with respect to the tooth 15, at a substantially identical height "q".

In other words that means that the screw 21 "traverses" at least in part the hooking area of the hook 11 itself: as one can clearly see in the drawings, said hook section 27 (in which the seat 26 is provided) substantially faces the tooth 15, thereby forming the hook shape itself and so delimiting in part the hooking area in which, in the operative condition, part of the support 17 is inserted.

According to the invention, the tip 23 (terminal part) of the screw 21, is engaged with a horizontal flap (edge) 16A, folded directly from the section 16 of bar 17.

In this way, side end stops 16B are automatically formed, without any additional operations, against which the hook 15 is buffered and blocked, in the case of a horizontal movement of the wall cupboard.

The anti-disengagement system according to the invention is consequently produced without any additional costly operations on the hook 11 and on the bar 17, and without any scraps of material.

The hanging-bracket device 10, produced as described above, is fixed to a wall cupboard, partially indicated with 29 and comprising shoulders 30, a top 31 and possibly a lining 32. More specifically, two of said hanging brackets 10, of which only one is shown, are fixed in correspondence with the upper rear corners (right and left) of said cupboard 29.

The functioning of the anti-disengagement system according to the invention is clearly illustrated in the operative sequence of FIGS. 1-9, and is briefly the following.

Figure 4:
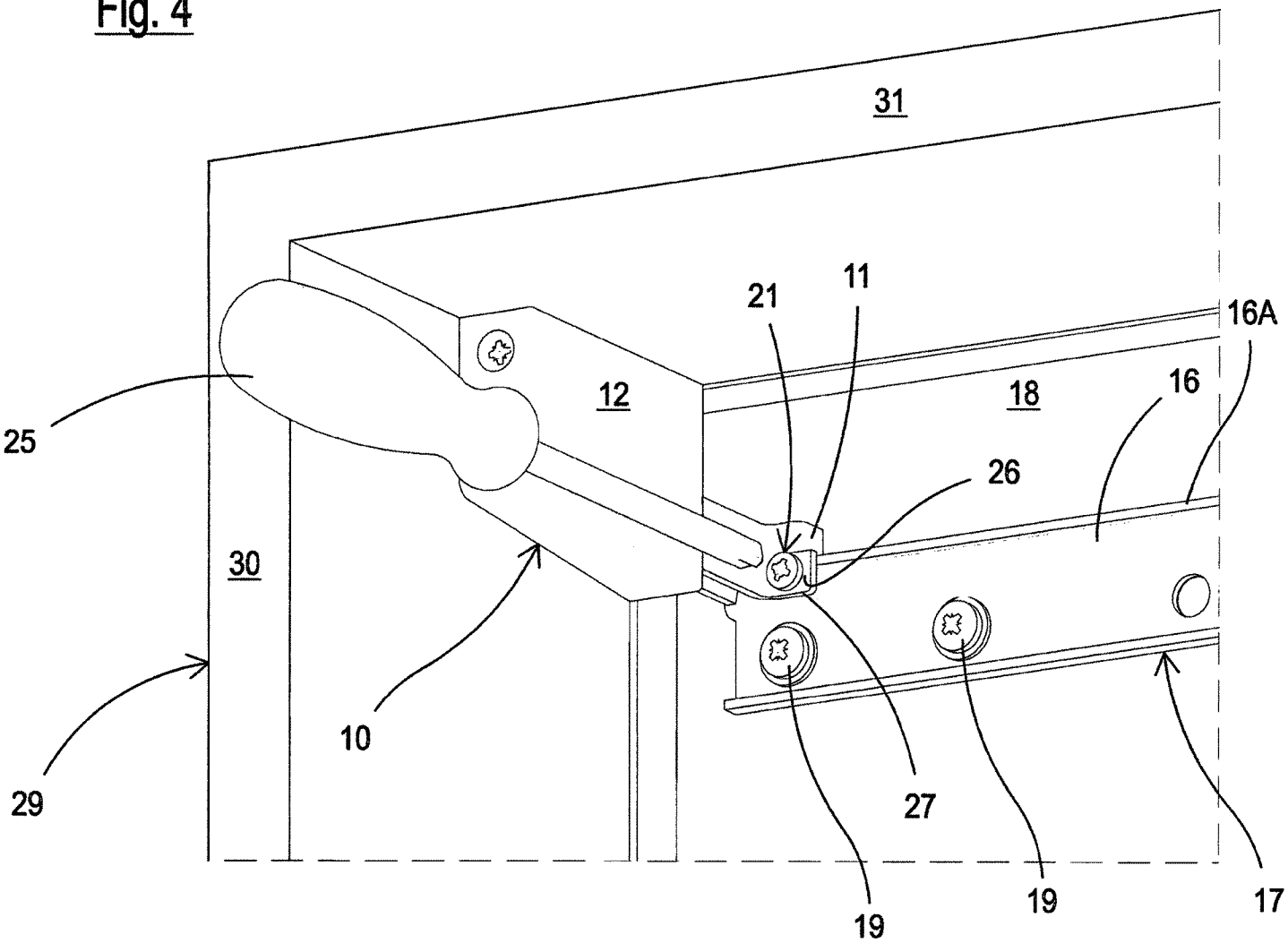
FIG. 4 is a perspective view similar to FIG. 1 illustrating the hanging bracket hooked to the bar fixed to the wall, but with the anti-disengagement system not yet activated (actuated)
Figure 6:
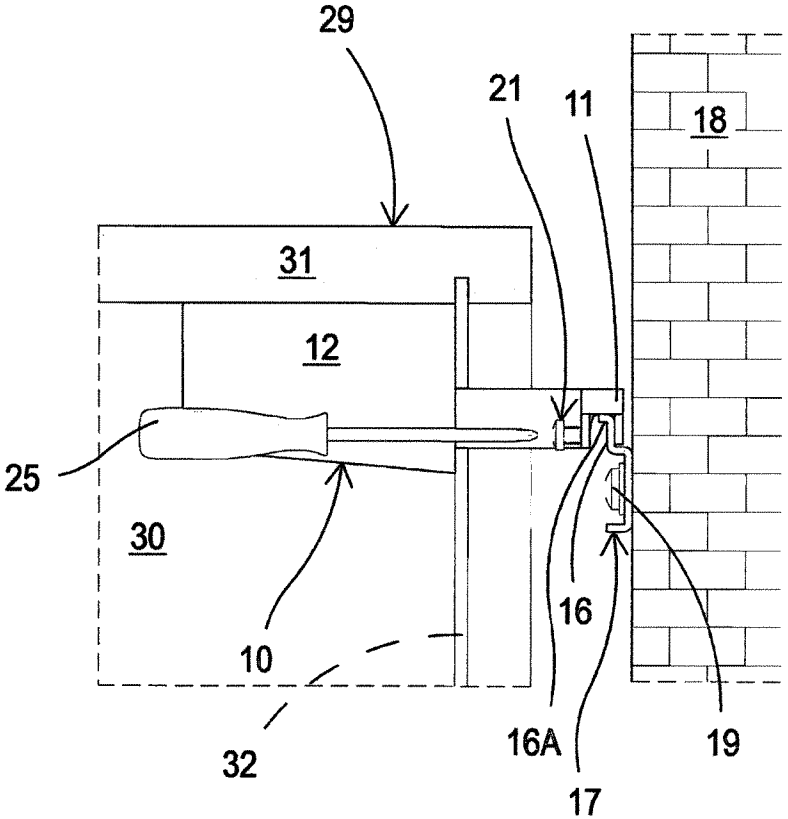
FIG. 6 is a detail in a vertical section of the cupboard of FIG. 4.
Figure 5:
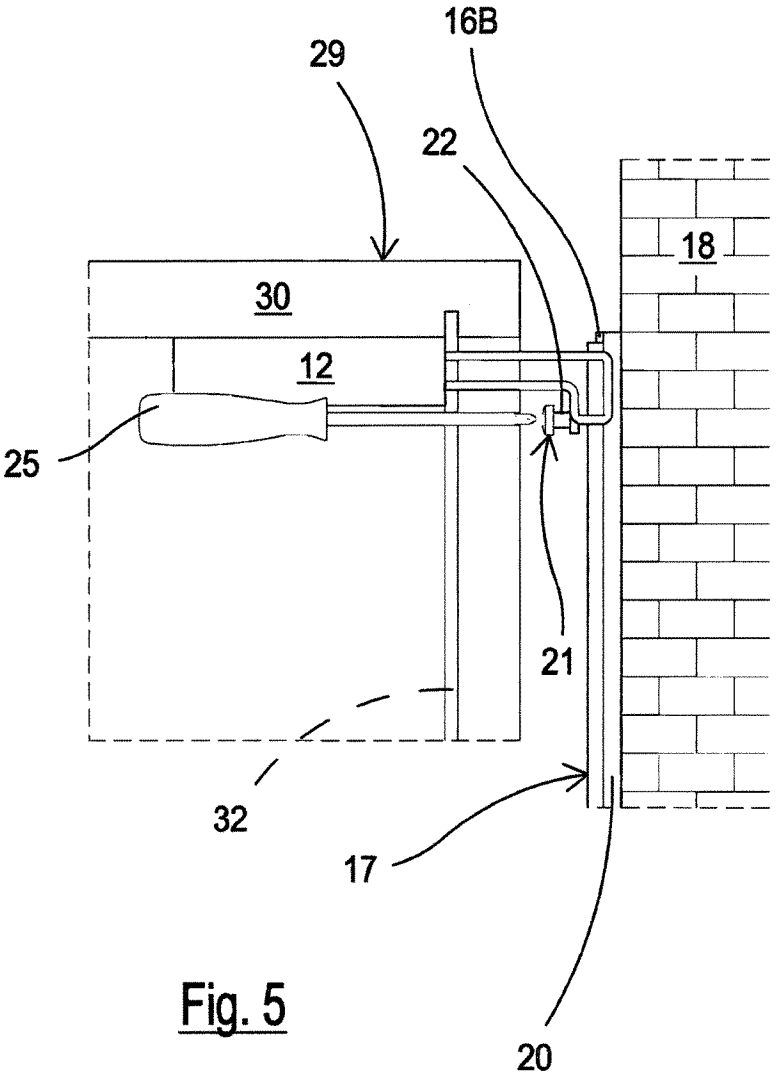
FIG. 5 is a detail in a plan section of the cupboard of FIG. 4.

The cupboard is hooked to the wall 18, with the screw 21 in a withdrawn non-operative position shown in FIGS. 1-6, by inserting the tooth 15 of the hook 11 in the channel 20 (FIGS. 4-6). In this way, due to the weight of the cupboard 29, the tooth 15 is engaged with the section 16 of the bar 17 (FIGS. 4-6).

Figure 7:
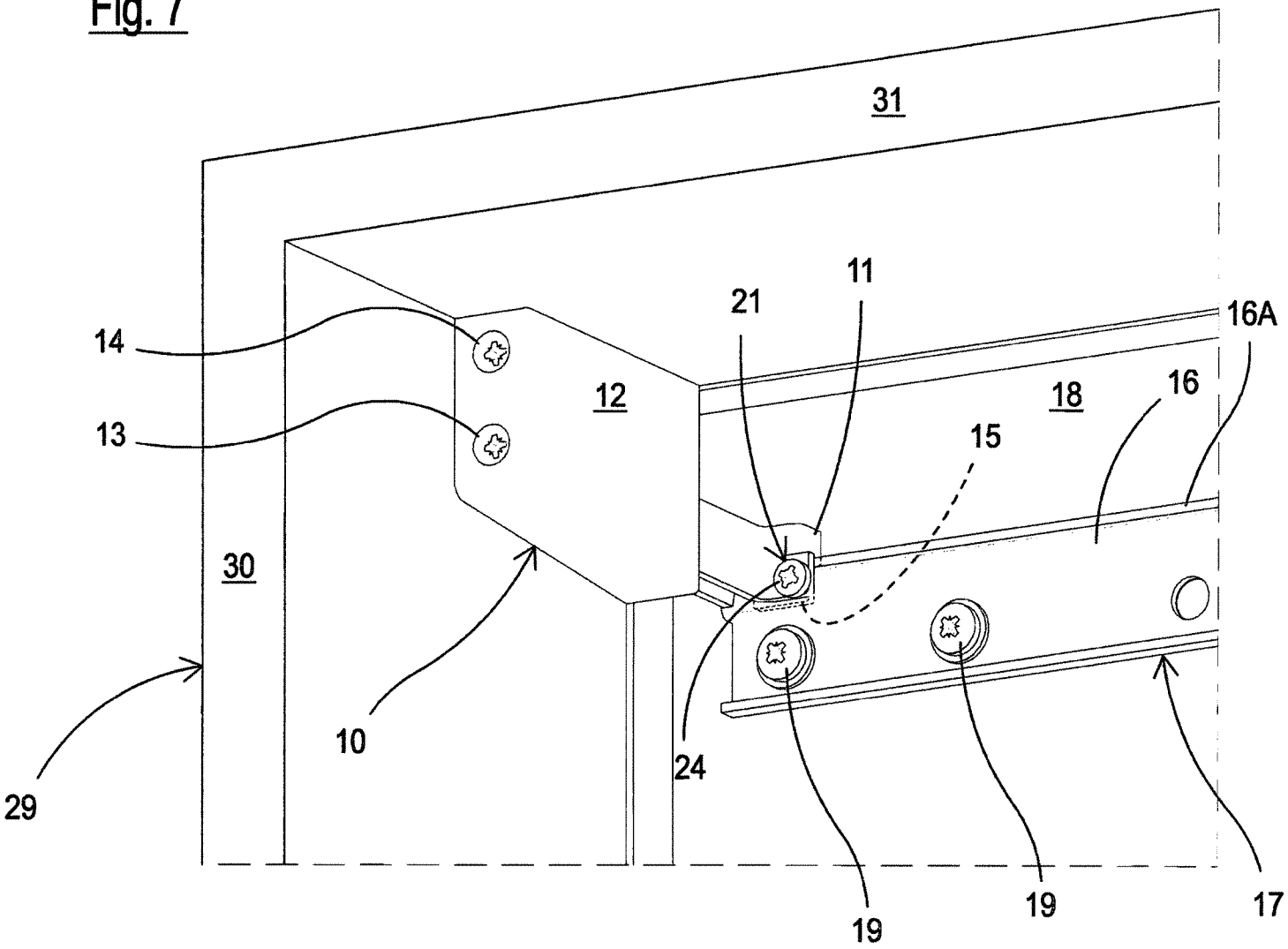
FIGS. 7, 8 and 9 are views similar to FIGS. 4, 5 and 6, respectively, illustrating the anti-disengagement system in the activated blocking position to the wall of the cupboard.
Figure 8:
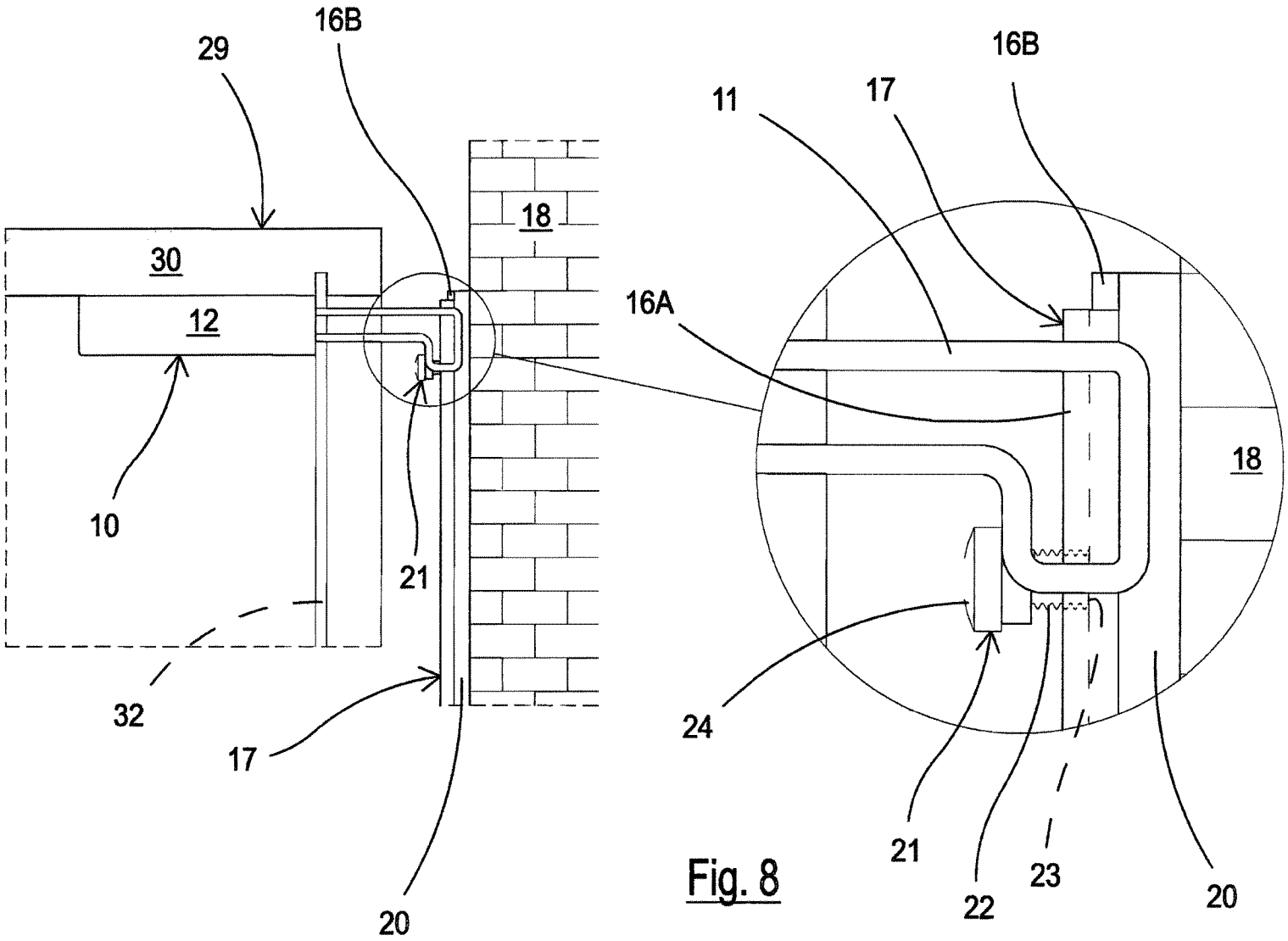
Figure 9:
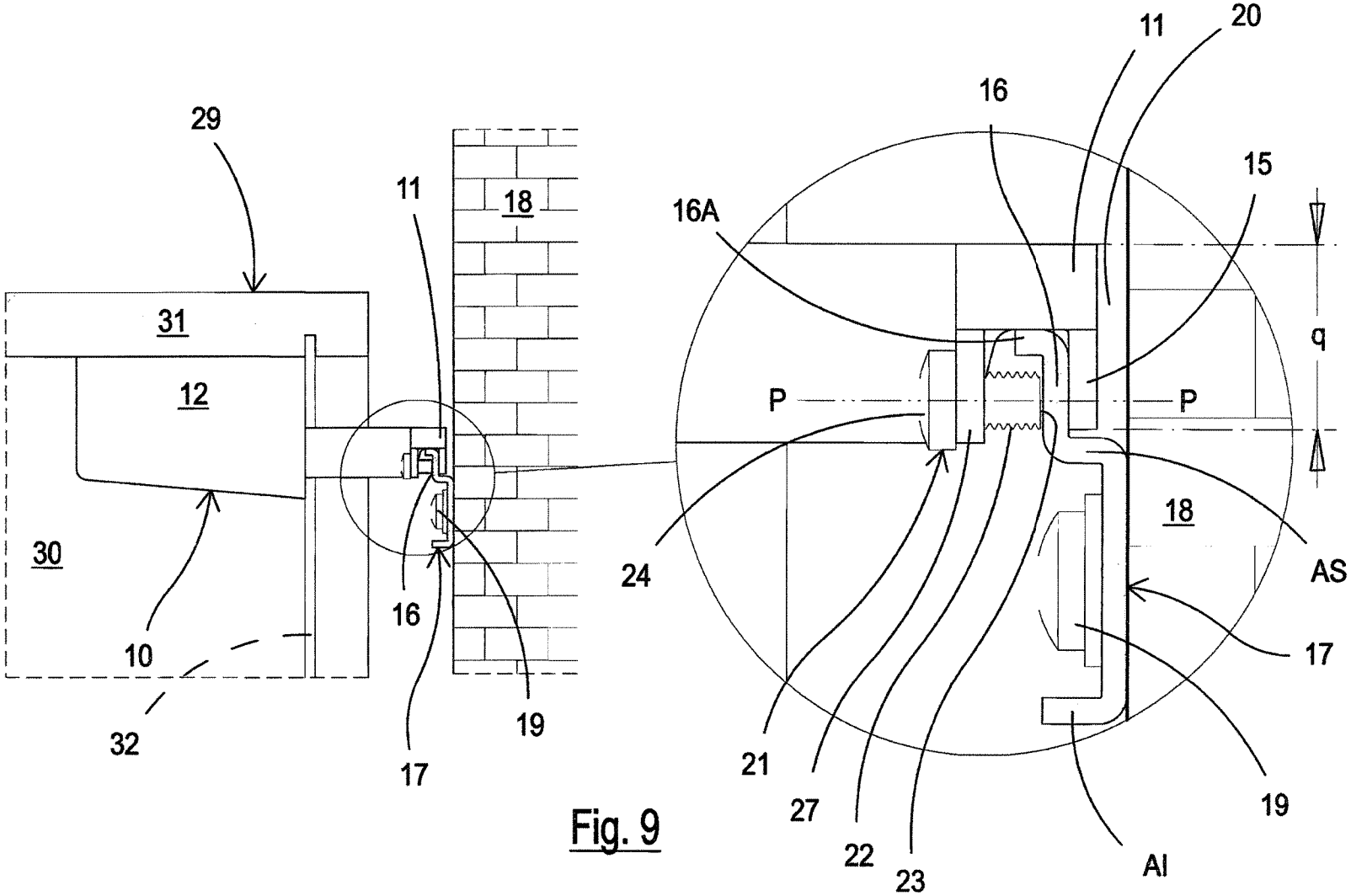

With the cupboard 29 thus positioned, the screw 21 is screwed, by means of the screwdriver 25, into the operative forward position of FIGS. 7-9, so as to bring the tip or terminal end 23 in engagement with the undercut formed by the horizontal flap 16A of the bar 17.

Once the system has been activated, the screw 21 typically lies on a plane P which is positioned under said flap 16A, substantially above said wing AS (FIG. 9).

In this way, it is evident that, in the case of the accidental application to the cupboard 29 of forces directed upwards, the interference between the screw 21 and the flap 16A prevents the disengagement of the tooth 15 from the section 16 of the bar 17. Furthermore, the presence of the side blocking stops 16B, between which the tooth 15 is positioned, prevents the cupboard 29 from falling, when subjected to accidental side forces, which could disengage the tooth 15 from channel 20 of the bar 17, causing the cupboard to fall.

In the case of necessity, on the contrary, the desired disengagement of the tooth 15 from the section 16 of the bar 17, is obtained by simply unscrewing the screw 21, so as to bring it back to the withdrawn non-operative position of FIGS. 1-6.

Figure 10:
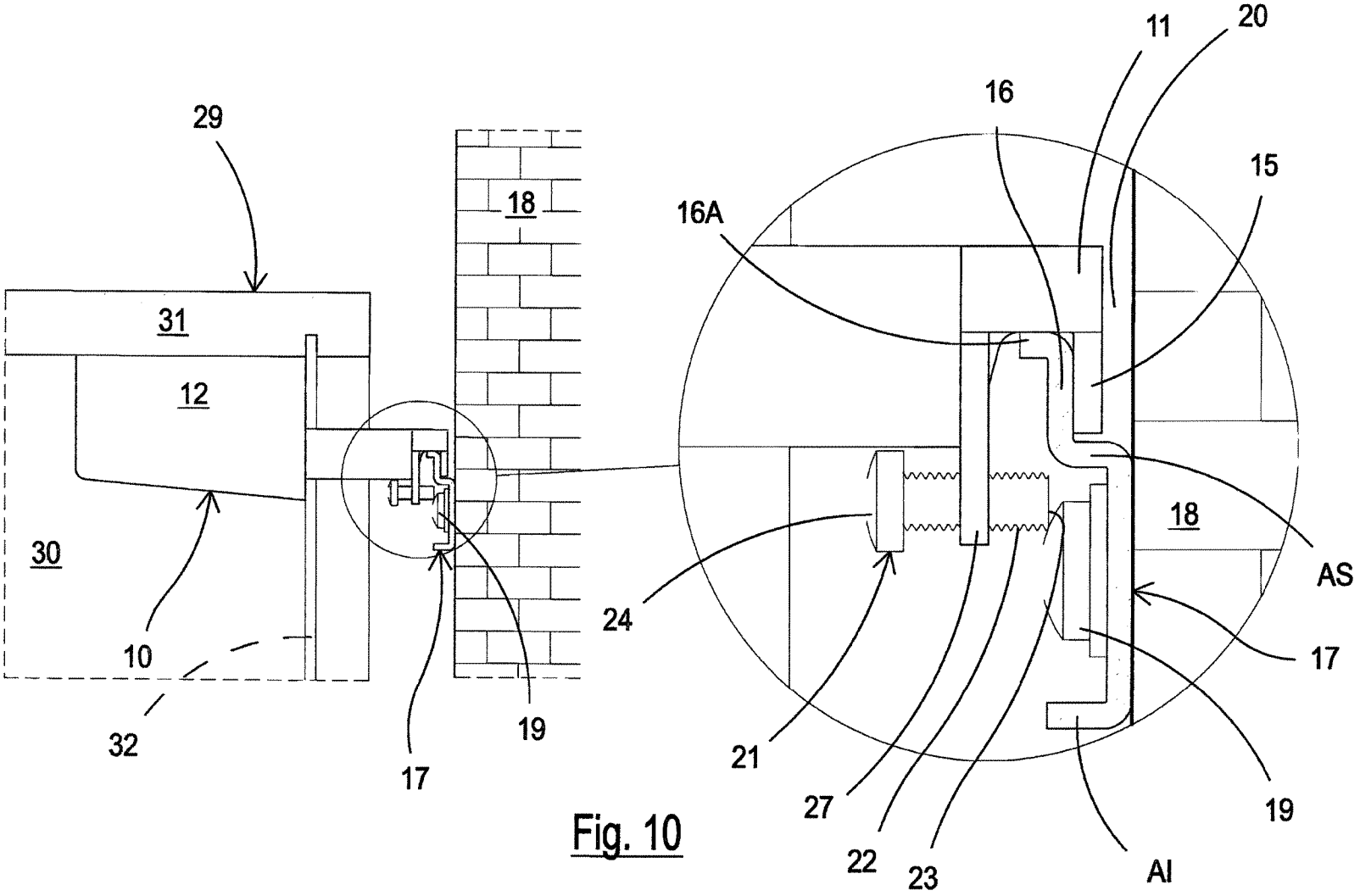
FIG. 10 is a vertical section illustrating an anti-disengagement system according to the known art, wherein the blocking screw cannot become operational (interact with the supporting plate) as it interferes with the head of the fixing screw or dowel to the wall of the plate itself on which the cupboard is hooked.

The objectives mentioned in the preamble of the description have therefore been achieved, in particular the extremely important objective of preventing the bead or screw 21 of the anti-disengagement system from encountering, during its screwing passage, the head of the fixing dowel or screw 19 of the support 17 (bar or plate), on the wall, as indicated in FIG. 10, which would make the same system ineffective, as the terminal part of the bead 21 could not become engaged with the undercut of the support 17 defined by the upper wing AS of the "C". In this respect, it should be noted that the hanging brackets, for evident reasons of loading resistance, are hooked above the fixing dowels or screws 19 of the support to the wall. This drawback can arise in the anti-disengagement systems according to the known art, consisting, for example of EPA 14164730.5.

Another object of the invention is a combination of said hidden hanging bracket and a support as described hereinabove.

The protection scope of the present invention is defined by the enclosed claims.

The invention claimed is:

1. A visible hanging bracket with an anti-disengagement system, for wall cupboards, wherein a cupboard is hooked to a support fixed to a wall, comprising:

a hook comprising a releasable reciprocal constraint system that engages said hook to said support, wherein said reciprocal constraint system comprises a first member receiving a screw screwed onto said first member and interfering with a front face of said support, and a second member engaging a rear face of said support, wherein said screw is screwed into a threaded seat positioned on said first member, said first member forming part of, and being incorporated in, said hook, said seat being substantially opposed, and not completely offset, with respect to said first member, and wherein a horizontal flap defined at an upper edge of said support and folded directly from said support extends between said first member and said second member.

2. The hanging bracket according to claim 1, wherein said first and said second member extends downwardly with a substantially identical vertical height.

3. The hanging bracket according to claim 1, further comprising side end-stops extending and formed from said support as a result of folding said horizontal flap.

4. The hanging bracket according to claim 1, wherein said second member is hooked to a corresponding section of said support, said section defining, with said wall, a channel, where the second member is housed, and wherein said horizontal flap is folded from said section.

5. The hanging bracket according to claim 4, wherein said support has an upper wing, extending substantially horizontal, said section extending vertically and upwardly from said upper wing, said horizontal flap being folded from an upper end of said section.

6. The hanging bracket according to claim 5, wherein said support has a "C" shaped section.

7. The hanging bracket according to claim 5, wherein said screw lies on a plane which is situated below said flap and substantially above said upper wing.

8. The hanging bracket according to claim 1, further comprising a regulation mechanism in horizontal depth and a regulation mechanism in vertical height with respective lead screws.

9. A combination comprising:

a visible hanging bracket with an anti-disengagement system, for wall cupboards, comprising:

a hook comprising a releasable reciprocal constraint system adapted to engage said hook to a support, wherein said reciprocal constraint system comprises a first member receiving a screw screwed onto said first member and adapted to interfere with a front face of said support, and a second member adapted to engage a rear face of said support, wherein said screw is screwed into a threaded seat positioned on said first member, said first member forming part of, and being incorporated in, said hook, said seat being substantially opposed, and not completely offset, with respect to said first member; and a support fixed to a wall, wherein the visible hanging bracket is adapted to hook onto said support, and wherein a horizontal flap defined at an upper edge of said support and folded directly from said support is dimensioned to extend between said first member and said second member.

* * * * *